US005562039A

United States Patent [19]

Fox et al.

[11] Patent Number: 5,562,039

[45] Date of Patent: Oct. 8, 1996

[54] METHOD FOR MOUNTING A FLEXIBLE PRINTING PLATE ONTO A PRINTING CYLINDER

[75] Inventors: David L. Fox, North Rose; John L. Fox, Rose, both of N.Y.

[73] Assignee: E. I. Du Pont de Nemours and Company, Wilmington, Del.

[21] Appl. No.: 524,008

[22] Filed: Sep. 5, 1995

[51] Int. Cl.[6] ..... B41F 21/00

[52] U.S. Cl. ..... 101/486; 101/415.1; 101/378; 101/383

[58] Field of Search ..... 101/415.1, 485, 101/486, 483, 479, 481, 378, 382.1, 383, 384, 376

[56] References Cited

U.S. PATENT DOCUMENTS

| | | | |
|---|---|---|---|
| 1,786,001 | 12/1930 | Casto | 101/383 |
| 3,295,443 | 1/1967 | Devon | 101/376 |
| 3,384,014 | 5/1968 | Berg | 101/415.1 |
| 4,380,956 | 4/1983 | Elworthy | 101/401.1 |
| 4,467,722 | 8/1984 | Klingelhoefer et al. | 101/426 |
| 5,086,699 | 2/1992 | Philpot | 101/383 |
| 5,088,408 | 2/1992 | Philpot | 101/415.1 |
| 5,092,238 | 3/1992 | Philpot | 101/415.1 |
| 5,103,729 | 4/1992 | Philpot | 101/415.1 |
| 5,127,327 | 7/1992 | Philpot | 101/415.1 |
| 5,402,727 | 4/1995 | Matsuo et al. | 101/486 |
| 5,410,964 | 5/1995 | Koelsch | 101/378 |

*Primary Examiner*—Eugene H. Eickholt

[57] ABSTRACT

The invention relates to a method and apparatus for mounting flexographic printing plate in registration onto a printing cylinder with a mounting bar and a carrier sheet having the plate mounted thereto. The mounting bar and the carrier sheet each have multiple openings which are located to assure consistent alignment between the bar and carrier sheet. The carrier sheet is secured in registration to the mounting bar by aligning the openings of the bar to the carrier sheet and inserting locking pins into the aligned openings. The method for mounting a flexographic printing plate further includes an apparatus for retaining an end of the carrier sheet to prevent its movement while drilling or punching the multiple openings.

15 Claims, 5 Drawing Sheets

METHOD FOR MOUNTING A FLEXIBLE PRINTING PLATE ONTO A PRINTING CYLINDER

BACKGROUND OF THE INVENTION

1. Field of the Invention

This invention relates to a method for mounting flexible materials onto a printing cylinder. More particularly, it relates to a method for mounting flexible printing plates in registration on the cylinder.

2. Description of the Prior Art

Flexographic printing plates are resilient relief image plates made of rubber or photopolymer materials which are used to print on a wide variety of substrates. One critical step in the printing process is the accurate positioning of the printing plates onto the printing cylinder. The printing plate must be positioned such that the printing is parallel to the axis of the cylinder, i.e., not skewed. In multicolor printing, the plates for each different color must be aligned so they print in register. Frequently, this positioning is accomplished using pin registration drilling and mounting devices. The printing plate cylinder is typically removed from the printing press, and the plates are mounted to the cylinder using registration holes often in combination with a separate mounting device. However, for some printing presses, such as those typically used to print corrugated containers, the printing cylinders generally are not removed from the press.

A conventional method for mounting flexographic plates for corrugated printing involves the use of a carrier sheet and a mounter proofer unit. One or more plates are mounted onto a large flexible sheet known as the carrier sheet, and attached with adhesive or stickyback tape. The carrier sheet is then placed on the printing cylinder of the press. For multicolor printing, the plates for each successive color are positioned onto their carrier sheets using a mounter/proofer unit with minor. This practice is time intensive, highly dependent on the operator's skills, and potentially fraught with errors and inconsistent results. As the demands for improved registration increase, this method becomes increasingly unsatisfactory.

A major advance in the method of mounting plates for corrugated printing was achieved by the introduction of a single-head drill. With this drill, the printer was able to drill registration holes in both the carrier sheet and the plates. The plates were then mounted on the carrier sheet using mounting pins and stickyback tape. Once the plates were mounted, the pins were removed. Thus the alignment of the plates on the carrier sheet was the same for each color and the need to use the mounter/proofer was eliminated. Both the speed and the accuracy of the mounting process were improved.

Although registration was improved, another source of registration or alignment error occurs when the carrier sheet is attached to a mounting bar. The carrier sheets are placed on the printing cylinder using the mounting bar which secures the sheet to the cylinder at a slot on the cylinder. In the comtgated printing industry, typically mounting bars are substantially T-shaped or J-shaped member. An end of the carrier sheet is aligned and secured to a mounting bar by stitching, gluing, or stapling. Improvements in registration are still impaired by these techniques which are used to attach the carrier sheet to the mounting bar. These techniques are cumbersome particularly when very large plates are being attached to the mounting bar. While gluing, stapling, or stitching the carrier sheet to the mounting bar, it is difficult to prevent shifting or movement of either. Shifting or movement will mis-align the plate on the printing cylinder and can result in misregistration. Further, once attached to the carrier sheet, the mounting bar is no longer reusable.

Thus, it is an object of the present invention to provide an improved method for attaching a carrier sheet to a mounting bar for use on a printing cylinder. The improved method of this invention is easy to use increasing productivity and substantially eliminates registration errors.

SUMMARY OF THE INVENTION

In accordance with the invention there is provided a method and apparatus for mounting a flexographic printing plate having a relief image on a printing cylinder having a slot, the method comprising:

(a) providing a sheet which is either a carrier sheet having the printing plate attached or the printing plate;

(b) punching at least two openings in the sheet spaced apart in a row parallel to the leading end;

(c) providing a bar having a first arm with a coupling end and a second arm with multiple openings spaced apart in a row parallel to the coupling end;

(d) aligning the at least two openings in the sheet to at least two of the multiple openings of the second arm;

(e) securing the bar to the sheet by placing locking pins in the openings aligned in step c); and (f) mounting the bar on the priming cylinder so the coupling end of the first arm engages the slot and remains in place on the cylinder during printing.

In addition to the inventive method and apparatus for mounting the plate on the cylinder, there is provided a flexographic printing element and a method of manufacturing the mountable flexographic printing element.

In accordance with the inventive method for mounting the plate on the cylinder, there is provided an apparatus for retaining an end of a sheet-like material in place on a table comprising:

a) a tubular member having a top side and a bottom side opposite the top side, the bottom side having channels;

b) a flexible cover member attached to the top side, and having extended portions contacting the end of the sheet and the table; and c) means for supplying a vacuum to the tubular member, so that the cover member forms an air seal and prevents the end of the sheet from movement.

DETAILED DESCRIPTION OF THE PREFERRED EMBODIMENT(S)

Figure 1A:
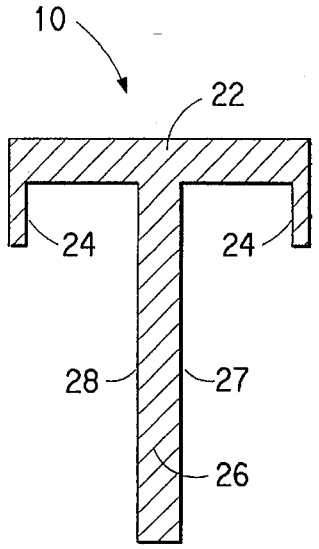
FIG. 1*a* is a cross-sectional view of a first embodiment of a bar having a T-shape for mounting a carrier sheet onto a printing cylinder.

Throughout the following detailed description, similar reference characters refer to similar elements in all figures of the drawings.

Figure 1B:
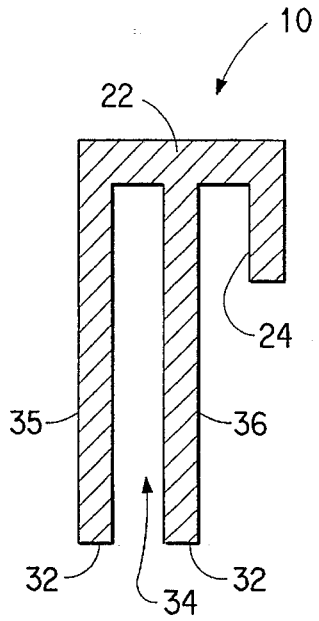
FIG. 1*b* is a is a cross-sectional view of a second embodiment of a bar having a J-shape for mounting a carrier sheet onto a printing cylinder.

Refering to FIGS. 1*a* and 1*b*, two embodiments are shown of a bar 10 for mounting flexographic printing plate 12 with a carrier sheet 14 onto a printing cylinder 16. The bar 10 may also be relented to as a mounting bar 10. Materials suitable for use as the bar 10 are not particularly limited provided that the material can be machined or punched or drilled to provide openings, does not deform under stress of securing the carrier sheet 14 as well as under the pressure of printing operation, and does not scratch the cylinder 16. Suitable materials are plastic or metal, preferred is plastic.

Figure 6:
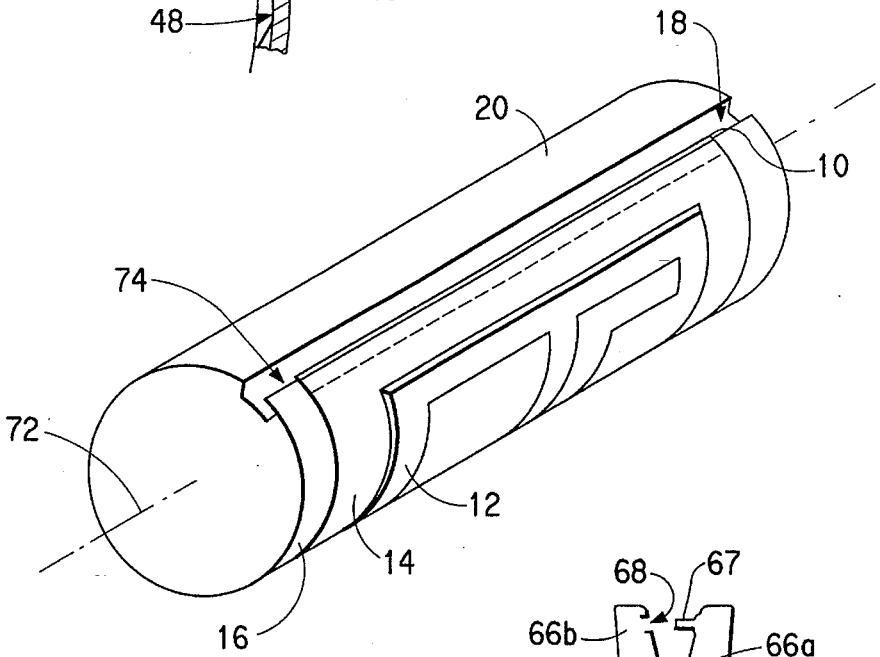
FIG. 6 is a perspective view of the printing cylinder with the printing plate mounted.

As shown in FIG. 6, the printing cylinder 16 includes a slot 18 on an outside periphery 20 of the cylinder 16 for mounting of the bar 10. The bar 10 has a length which is selected to correspond at a minimum to a width of the carrier sheet 14 but is no longer than a slot 18 on the printing cylinder 16. Both embodiments of the bar 10 provide for attaching of a leading end 21 of the carrier sheet 14 and for coupling of the bar 10 to the slot 18 in the cylinder 16.

Figure 2:
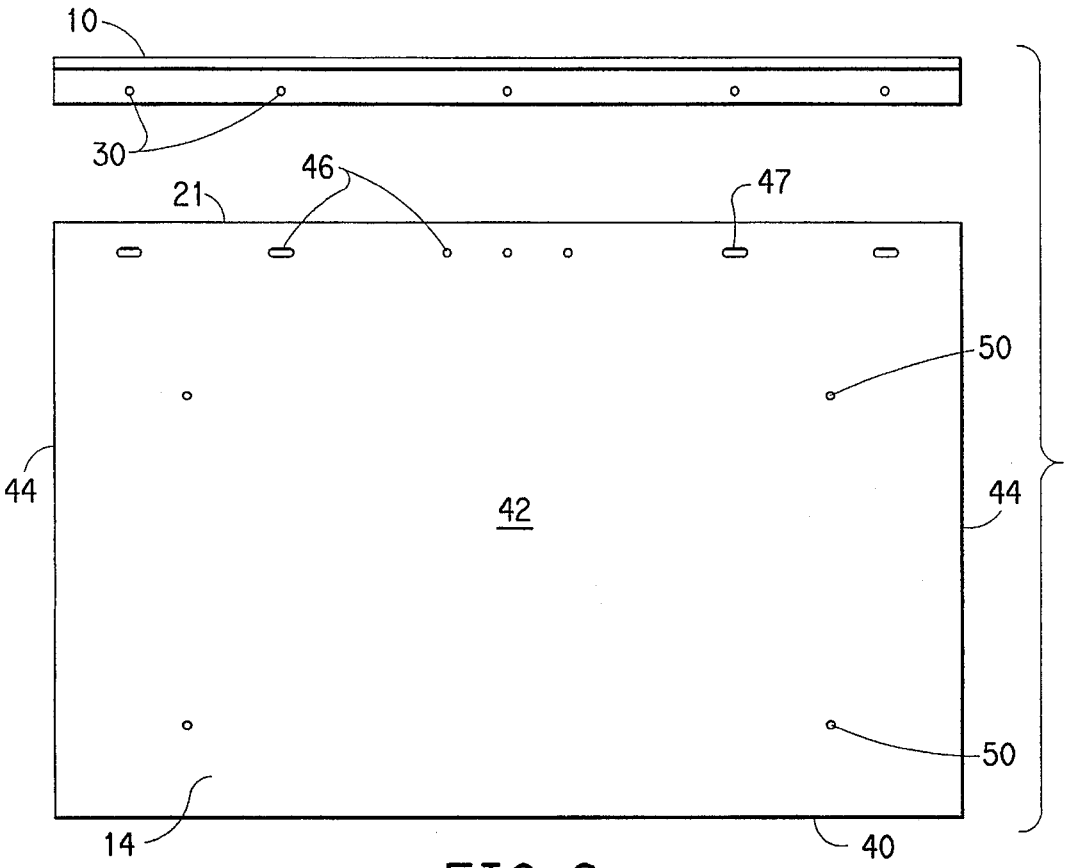
FIG. 2 is a planar view of the first embodiment of the mounting bar having multiple circular openings and the carrier sheet having at least two openings in a row parallel to a leading end for aligning and securing the bar to the carrier sheet.

Refering to FIG. 1*a*, a first embodiment of the bar 10 is substantially T-shaped. The bar 10 includes a first arm 22 with coupling ends 24 and a second arm 26 for attaching the carrier sheet 14. Although there are two coupling ends 24 of the first arm 22, only one of the coupling ends 24 is necessary to engage the slot 18 on the printing cylinder 16. The second arm 26 is perpendicular or substantially perpendicular to the first arm 22. The second arm 26 has a top side 27 and a bottom side 28. The second arm 26, as shown in FIG. 2, has a multiplicity of openings 30 which form apertures from the top side 27 to the bottom side 28. The openings 30 are spaced in a row along length of the bar 10, parallel to the first arm 22. Preferably the multiplicity of openings 30 are circular shaped holes. The carrier sheet 14 can be attached to either the top side 27 or bottom side 28 of the second arm 26. As such, the coupling end 24 of the first arm 22 opposite the side of the second arm 26 which the carrier sheet 14 is attached, is the end which couples to the cylinder 16.

Refering to FIG. 1*b*, a second embodiment of a bar 10 is substantially J-shaped. The bar 10 includes a first arm 22 with a coupling end 24 and two spaced members 32 forming a recess 34 for attaching the carrier sheet 14. The two spaced members 32 are perpendicular or substantially perpendicular to the first arm 22. The two spaced members 32 have a top side 35 and a bottom side 36. Each of the two spaced members 32 have a multiplicity of openings 30 which are aligned to form apertures (not shown) from the top side 35 to the bottom side 36. The aligned apertures 30 are spaced in a row along length of the bar 10, parallel to the first arm 22. Preferably the multiplicity of openings 30 are circular shaped holes. The leading end 21 of the carrier sheet 14 resides in the recess 34 formed by the two spaced members 32 for attachment of the carrier sheet 14 to the bar 10.

Openings 30 are punched or drilled in the second arm 26 of the first embodiment of the bar 10 and in the two spaced members 32 of the second embodiment of the bar 10 by conventional means. The multiplicity of openings 30 for the bar 10 can be as few as two openings, but preferably is more than two. The number of openings 30 in the bar 10 is dependent upon the spacing between openings 30 and the length of the bar 10.

Referring to FIG. 2, a carrier sheet 14 has a leading end 21, a trailing end 40, a top side 42 and side ends 44. At least two openings 46 are spaced apart in a row located near and parallel to the leading end 21 of the carrier sheet 14. The openings 46 form an aperture through the carrier sheet 14. It is preferred that there are more than two openings 46 in the carrier sheet 14 which includes circular-shaped holes and oblong-shaped holes 47. The additional openings 46, particularly the oblong-shaped holes 47, are present to aid in securing the carrier sheet 14 to the bar 10 and allow for some freedom in the alignment of the carrier sheet 14 to the bar 10. As can be seen in FIG. 2, the oblong-shaped holes 47 are generally positioned so that a long dimension of the oblong is parallel to the leading end 21 and a short dimension is perpendicular to leading end 21. Two of the at least two openings 46 in the carrier sheet 14 have spacing which corresponds to the spacing between two of the multiplicity of openings 30 in the bar 10. The openings 30 in the bar 10 and multiple openings 46 on the leading end 21 of the carrier sheet 14 are both spaced at the same distance apart, or substantially at the same distance apart relative to the oblong-shaped openings 47, and can then be easily aligned. Two openings 46 in the carrier sheet 14 corresponding to the spacing of the two openings 30 in the bar 10 assures registration of the carrier sheet 14 to the mounting bar 10. Preferably, when only two openings in the carrier sheet are used the openings which align to the openings in the mounting bar should both be circular-shaped or one opening circular-shaped and the other opening oblong-shaped. In this manner, plate registration is assured in a vertical (circumferential, relative to printing cylinder) direction by alignment of the circular opening in the carrier sheet to the circular opening in the mounting bat and in a side-to-side (axial, relative to the cylinder) direction by the alignment of oblong or circular opening in the carrier sheet to the circular opening in the bar. Materials suitable for use as the carrier sheet 14 can be any which are flexible to wrap about the print cylinder 16, resistant to deformation and stretching particularly during printing, examples of which are vinyl plastics, linoleum, and polyester. Suitable thickness of the carrier sheet 14 is from 0.005 to 0.185 in. (0.013 to 0.47 cm), preferably 0.005 to 0.045 in. (0.013 to 0.11 cm) Most preferred is polyester of thickness between 0.030 in (0.076 cm).

Figure 4:
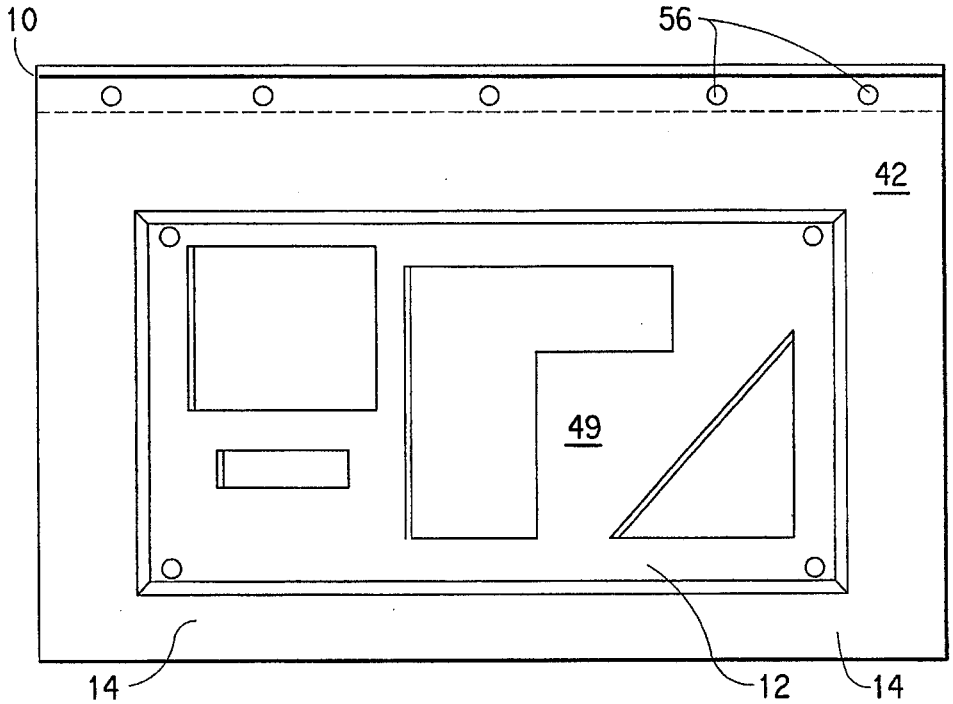
FIG. 4 is a planar view of the carrier sheet secured to the bar and having the printing plate mounted on the carrier sheet.

The flexographic priming plate 12 includes plates which are made of photopolymeric materials and rubber materials. Preferred are photopolymeric printing plates. The printing plate 12 includes a relief image side 49 and a back side 48 opposite the relief side 49. The relief image is formed by imagewise exposure and wash-out by conventional means as disclosed for example in U.S. Pat. No. 4,369,246. Refering to FIG. 4, the bar 10 is attached to the carrier sheet 14 and the printing plate 12 is mounted with the back side 48 to the top side 42 of the carrier sheet 14 so that the relief image side 49 faces outward. Typically the plate 12 is held in place on the carrier sheet 14 by an adhesive (not shown).

Methods suitable for mounting the printing plate 12 in registration on cattier sheet 14 are well known in the art. One method for mounting the printing plate 12 on the carrier sheet 14 includes the use of a mounter/proofer apparatus for multicolor printing in which the plates 12 for each successive color are positioned onto their carrier sheets 14 with a mirror by an operator. A preferred method of mounting plates 12 onto the carrier sheet 14 is by the use of a single-head drill as disclosed by Haggerty et al. in U.S. Pat. No. 5,439,328. In the preferred embodiment used with the single-head video drill, the carrier sheet 14 also includes a second set of multiple openings 50 used for mounting of the flexographic printing plate 12. The second set of multiple openings 50 is typically located internal to the carrier sheet 14, i.e., not along the ends of the carrier sheet 14. Generally the spacing and number of the second set of openings 50 is dependent upon the size of the printing plate 12 being mounted to the carrier sheet 14 and the number of registration targets on the plate 12 which need to be aligned for the plate 12 to be registered. The single-head drill drills registration holes in both the carrier sheet 14 and the plate 12 at the registration targets imaged on the printing plate 12. During drilling of one or more of the carrier sheets 14, the sheets 14 are aligned and prevented from movement by pins 52 on a table 54 associated with the single-head drill which mate with the at least two openings 46 in the leading end 21 of the carrier sheet 14. The plate 12 is then mounted on the carrier sheet 14 using mounting pins and stickyback tape (not shown). Once the plate 12 is mounted, the pins are removed.

The openings 30 in the bar 10, and the lead end openings 46 and the mounting openings 50 in the carrier sheet 14 can be machined, punched or drilled by conventional equipment. As is within the skill in the art, conventional punching equipment and conventional drilling equipment may need modification to accommodate the requirements of this invention. Sources of conventional punching equipment are manufacturers of film punches for the printing industry such as Stoesser or Carlson. Conventional drilling equipment for use in the printing industry can be supplied by Black and Decker or Bridgeport for example. A preferred drill is the Cyrel® Video Head Drill sold by E. I. DuPont de Nemours (Wilmington, Del.). Mounting bars having openings for mounting with a cattier sheet may be supplied from JDL Machine Company, North Rose, N.Y.

Figure 3:
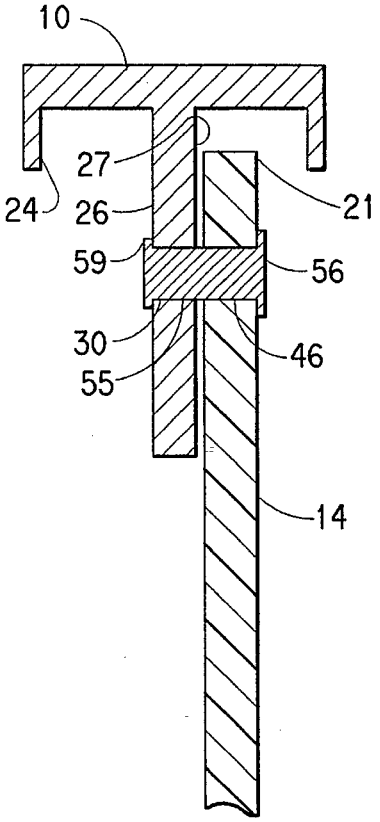
FIG. 3 is a cross-sectional view of the first embodiment of the bar showing attachment to the carrier plate with a locking pin.

Referring to FIG. 3, the carrier sheet 14 is secured to the first embodiment of the bar 10 on either the top side 27 or bottom side 28 of the second arm 26, by aligning the openings 30 in the bar 10 with the openings 46 in the leading end 21 of the carrier sheet 14 and securing the alignment between the bar 10 and carrier sheet 14 with locking pins 56. Similarly, the carrier sheet 14 is secured to the second embodiment of the bar 10 by inserting the leading end 21 of the carrier sheet 14 into the recess 34 between the two spaced members 32 and aligning the openings 30 in the bar 10 to the openings 46 in the leading end 21 of the carrier sheet 14. Hereto, a locking pin 56 is inserted in each of the aligned openings 55 to secure the alignment between the bar 10 and the carrier sheet 14.

Figure 3A:
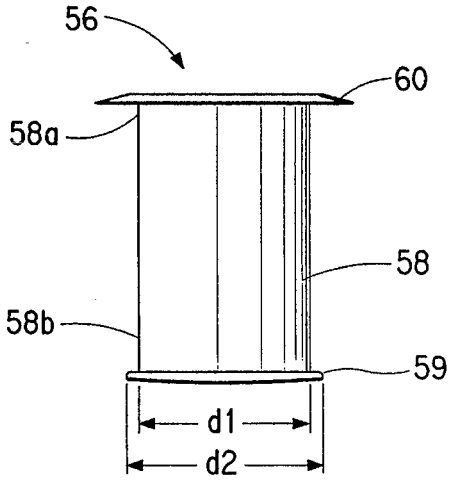
FIG. 3*a* is a front view of a preferred embodiment of the locking pin.

Referring to FIG. 3*a*, the locking pin 56 includes a shaft 58, locking cap 59 and a base 60. At a first end 58a of the shaft 58, the base 60 is perpendicular or substantially perpendicular to the shaft 58. The locking cap 59 is at or near a second end 58*b* of the shaft 58. A cross-section of the shaft 58 is substantially the same shape as that of the at least two aligned openings 55 of the bar 10 and carrier sheet 14. That is, the preferred shape of the shaft 58 is cylindrical having a diameter d1 substantially corresponding to the diameter of the circular shape of the openings 30 and 46 particularly the openings 30 in the bar 10. In the case where the oblong-shaped hole 47 in the carrier sheet 14 aligns with the circular shape hole in the bar 10, the size, i.e., diameter d1, and shape of the shaft 58 of the locking pin 56 corresponds to the size and shape of the smallest opening, i.e., the opening 30 in the bar 10. Further, the shortest dimension of the oblong-shaped holes 47 is the same or substantially the same as the diameter d1 of the shaft 58. Thus, the fitting of the locking pin 56 in the aligned opening 55 is such that it prevents any slip or movement between the carrier sheet 14 and the mounting bar 10, particularly during the printing operation.

The locking cap 59 forms a ridge on the shaft 58 at or near the second end 58b of the locking pin 56. The locking cap 59 has a slightly greater diameter d2 than the diameter d1 of the shaft 58 to allow for the insertion of the second end 58*b* of the locking pin 56 into the aligned opening 55 and to prevent the locking pin 56 from falling or easily pulling out of the aligned opening 55, that is, the locking pin 56 is retained in the aligned opening 55. Since the diameter d2 of the locking cap 59 is larger than the diameter of the openings 30 in the bar 10, the locking pin 56 snap fits into the aligned openings 55. The shaft 58 of the locking pin 56 has a length so that it extends through all the thicknesses of the carder sheet 14 and the bar 10 at the aligned opening 55 and protrudes from the bottom side 28, 36 of the bar 10, engaging the locking cap 59 on the bottom side 28, 36 of the bar 10. The base 60 of the locking pin 56 has a larger diameter than that of the openings 30,46 to prevent it from pulling through when the locking pin 56 is inserted into the aligned opening 55 or when under stress. The base 60 is substantially flat with minimal height above the top side 42 of the carder sheet 14, or mounting bar 10. Thus the base 60 and the locking cap 59 of the locking pin 60 secure the bar 10 and carrier sheet 14 together in alignment. Materials suitable for use as the locking pin 56 are any which can be easily formed to the desired shape and provide the strength to secure the carrier sheet 14 to the bar 10, examples of which are metals, plastic, and synthetic resins. Although metal can be used, metal is generally not desirable as a locking pin since it may damage the printing cylinder 16. A preferred material for the locking pin is LEXAN® synthetic resin.

It should be understood that although the preferred shape of the openings 30 in the bar 10 and the preferred shape of at least two of the openings 46 in the carrier sheet 14 are circular, the openings 30,46 can have any size and shape provided that the shaft 58 of the locking pin 56 used to secure the carder sheet 14 to the bar 10 is substantially the same size and shape as the openings 30,46.

Figure 11:
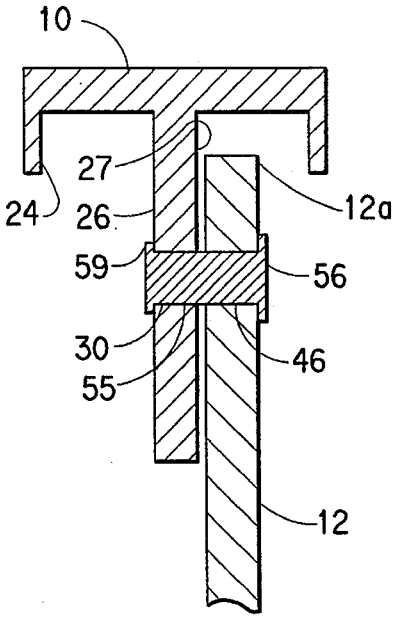
FIG. 11 is a cross-sectional view of an alternate embodiment of mounting the printing plate directly to the bar with locking pins.

FIG. 11 shows an alternate embodiment of mounting the printing plate 12 to the printing cylinder 16 using the bar 10 and locking pins 56. In this alternate embodiment, the printing plate 12 is directly secured to the bar 10, eliminating the carrier sheet 14. An additional advantage is that the step to mount in registration the printing plate 12 on the carrier sheet 14 is eliminated. In this embodiment, a leading end 12*a* the printing plate 12 is provided with at least two spaced openings 46 the same as or similar to the openings 46 at the leading end 21 of the carrier sheet 14. Thus the above description of the at least two openings 46 at the leading end 21 of the carrier sheet 14 is applicable to the openings 46 at the leading end 12*a* of the printing plate 12 for this embodiment. The at least two spaced openings 46 in the printing plate 12 are punched or drilled in the leading end 12*a*. It is contemplated that a conventional punching apparatus for the carrier sheet 14 may be modified with, for example, a video camera, to assure that the openings 46 are accurately positioned on the leading end 12*a* of the printing plate 12. The relief image on the printing plate 12 is formed prior to mounting the printing plate 12 on the bar 10. In this embodiment, a sufficiently sized printing plate 12 may be needed to accommodate multiple relief images which in the previous embodiment would have been mounted independently as printing plates 12 on the carrier sheet 14. In the alternate embodiment depicted in FIG. 11, the printing plate 12 is secured to the first embodiment of the bar 10 on either the top side 27 or bottom side 28 of the second arm 26, by aligning the openings 30 in the bar 10 with the openings 46 in the leading end 12*a* of the printing plate 12 and, securing the alignment between the bar 10 and printing plate 12 with locking pins 56. Similarly, the printing plate 12 is secured to the second embodiment of the bar 10 by inserting the leading end 12*a* of the printing plate 12 into the recess 34 between the two spaced members 32 and aligning the openings 30 in the bar 10 to the openings 46 in the leading end 12*a* of the printing plate 12. Hereto, a locking pin 56 is inserted in each of the aligned openings 55 to secure the alignment between the bar 10 and the printing plate 12. The bar 10 having the printing plate 12 directly attached can then be similarly mounted to the printing cylinder 16 as described below.

The flexographic printing plate 12 typically includes a support having a thickness from 2 to 10 mils (0.0051 to 0.025 cm), for the photosensitive layer. It is contemplated that the support of the flexographic printing plate 12 may need have a thickness greater than 10 mils (0.025 cm) in order to securely support the printing plate 12 on the bar 10.

For the purposes of this invention, a sheet can be either a carrier plate 14 having attached thereto at least one printing plate 12, or a printing plate 12.

In addition to the improvement to the registration accuracy, another advantage of the present invention is that the locking pin 56 and mounting bar 10 are reusable. While the locking pin 56 has the strength to secure and to retain the position of the carrier sheet 14 to the mounting bar 10 during printing operation, the locking pin 56 can also be removed from the mounting bar 10 and carrier sheet 14 used for current printing job, and reused again along with the bar 10 for another printing job.

Figure 7:
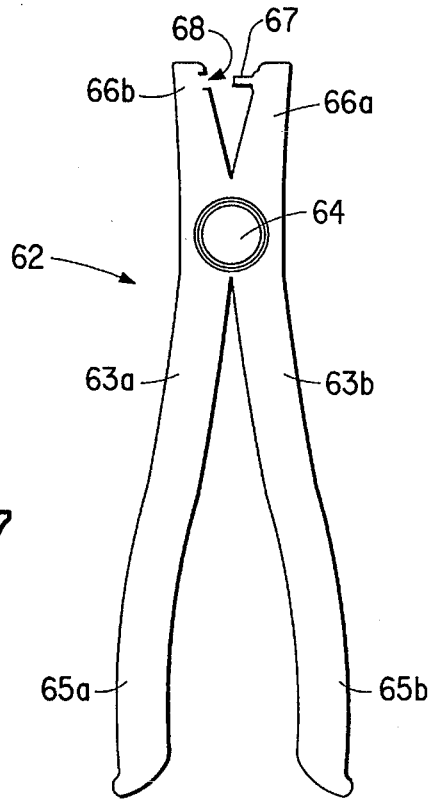
FIG. 7 is a planar view of tool used to remove the locking pin from the bar and carrier plate.

The locking pin 56 is preferably removable from the aligned opening 55 with the aid of a plier-like tool 62 shown in FIG. 7. The plier-like tool 62 includes two members 63*a*, 63*b* connected at a pivot location by bolt 64, in a jaw-like manner. Each of the two members 63*a*,63*b* has a handle end 65*a*,65*b* and a pin removal end 66*a*, 66*b*. The pin removal end 66*a* of one member 63*a* has a protrusion 67 perpendicular or substantially perpendicular to the member 63*a*. The protrusion 67 is cylindrically shaped having a diameter to correspond to the shape and diameter of the second end 58*b* of the shaft 58 of the locking pin 56. The pin removal end 66*b* of the other member 63*b*, includes a cavity 68 corresponding the base 60 of the locking pin 56. In operation to remove the locking pin 56 from the aligned opening 55 of the mounting bar 10 and the carrier sheet 14, the pin removal ends 66*a*,66*b* of the plier-like tool 62 is placed about the bar 10 and carrier sheet 14 such that the protrusion 67 resides on the second end 58*b* of the locking pin 56 and the base 60 of the locking pin 56 placed at the cavity 68. The handles 65*a*, 65*b* of the tool 62 are closed, i.e., brought together, bringing the pin removal ends 66*a*,66*b* of the two members 63*a*, 63*b* together such that the locking cap 59 of the locking pin 56 is forced out through the aligned opening 55, and the base 60 resides in the cavity 68 in the tool 62 to hold the locking pin 56. The protusion 67 may enter the aligned opening 55, but can be easily removed when the tool 62 is opened, i.e., the handles 65*a*, 65*b* are moved away from each other.

Figure 5:
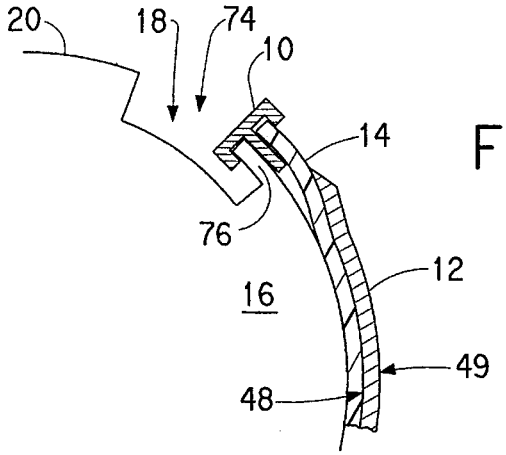
FIG. 5 is a side view of a printing cylinder having a slot with an extended member for engaging the bar with carrier sheet to the cylinder.

Referring to FIGS. 5 and 6, a printing cylinder 16 is shown having a longitudinal axis 72, the peripheral outside surface 20 and the slot 18 having an opening 74 which is substantially flush with the peripheral surface 20 of the cylinder 16. The slot 18 includes a member 76 which extends into the opening 74 substantially flush with the periphery of the cylinder 20, hereinafter referred to as the extended member 76. The slot 18 and the extended member 76 are parallel to the longitudinal axis 72 of the cylinder 16 and correspond in length to the cylinder 16. The coupling end 24 of the bar 10 engages the extended member 76 of the slot 18 to securely mount the printing plate 12 via the carrier sheet 14 to the printing cylinder 16. Unlike other printing techniques, in the corrugated printing industry the printing cylinder 16 is designed with the slot 18 so that the mounting bar 10 can remain and secure the plate to the cylinder 16 during the printing process. The trailing end 40 of the carrier sheet 14 is secured to the printing cylinder 16 by conventional means such as tape or strap-like devices.

Although the above described method to attach carrier sheet 14 to a mounting bar 10 is easier and faster than sewing, gluing or stapling of the bar 10 to the carrier sheet 14 as well as improves registration accuracy, a further improvement in assuring registration accuracy can be accomplished by use of an apparatus for retaining one or more carrier sheets 14 during the drilling operation.

Carrier sheets 14 oftentimes have an inherent curl due to the way they are manufactured and/or packaged. And even though the punched openings 30 of the carrier sheets 14 engage the table pins 52 associated with the drilling apparatus to substantially prevent the leading end 21 of the carrier sheet 14 or sheets from movement during drilling, the trailing end 40 and the side ends 44 are not held to prevent movement during drilling. Thus any movement by the trailing end 40 or the side ends 44 of the carrier sheets 14 due to curling of the carrier sheets 14 can affect the resulting alignment and registration of the printed image. Shifting or movement of the carrier sheets 14 particularly occurs when several carrier sheets 14 are drilled at one time. It is contemplated that the apparatus for retaining a carrier sheet 14 can also be used during the punching operation.

Figure 8:
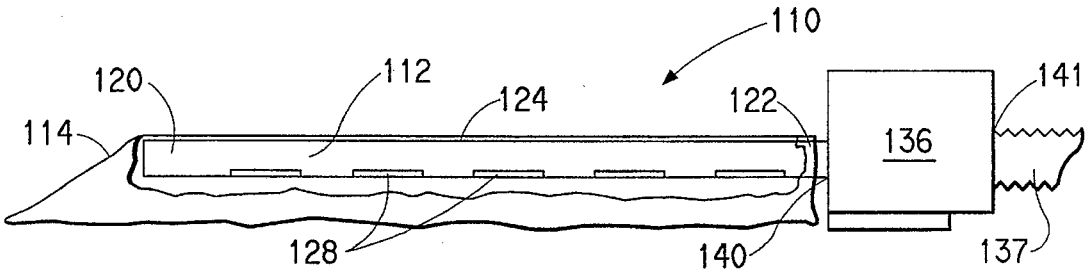
FIG. 8 is a side view of an apparatus for retaining at least one carrier sheet in position during punching and/or drilling, with a portion of a cover of the apparatus cut-away.
Figure 9:
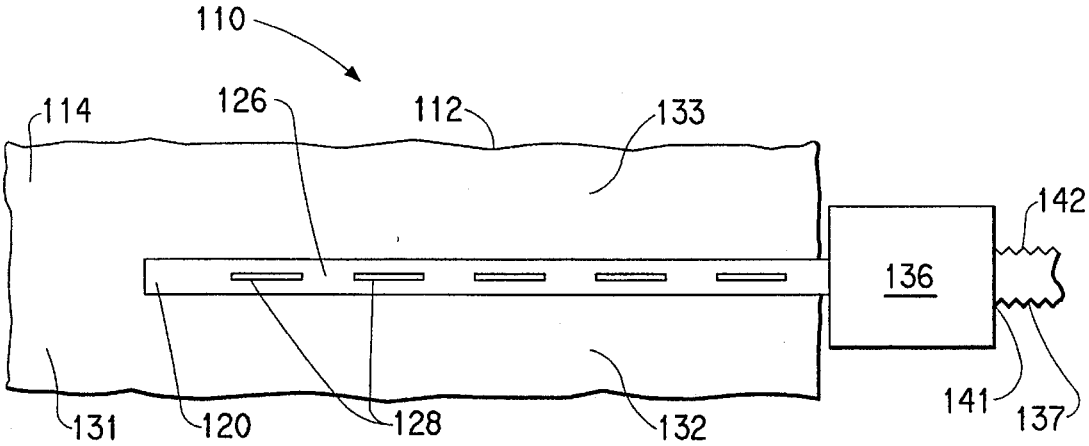
FIG. 9 is bottom planar view of the apparatus for retaining the carrier sheet in position.
Figure 10:
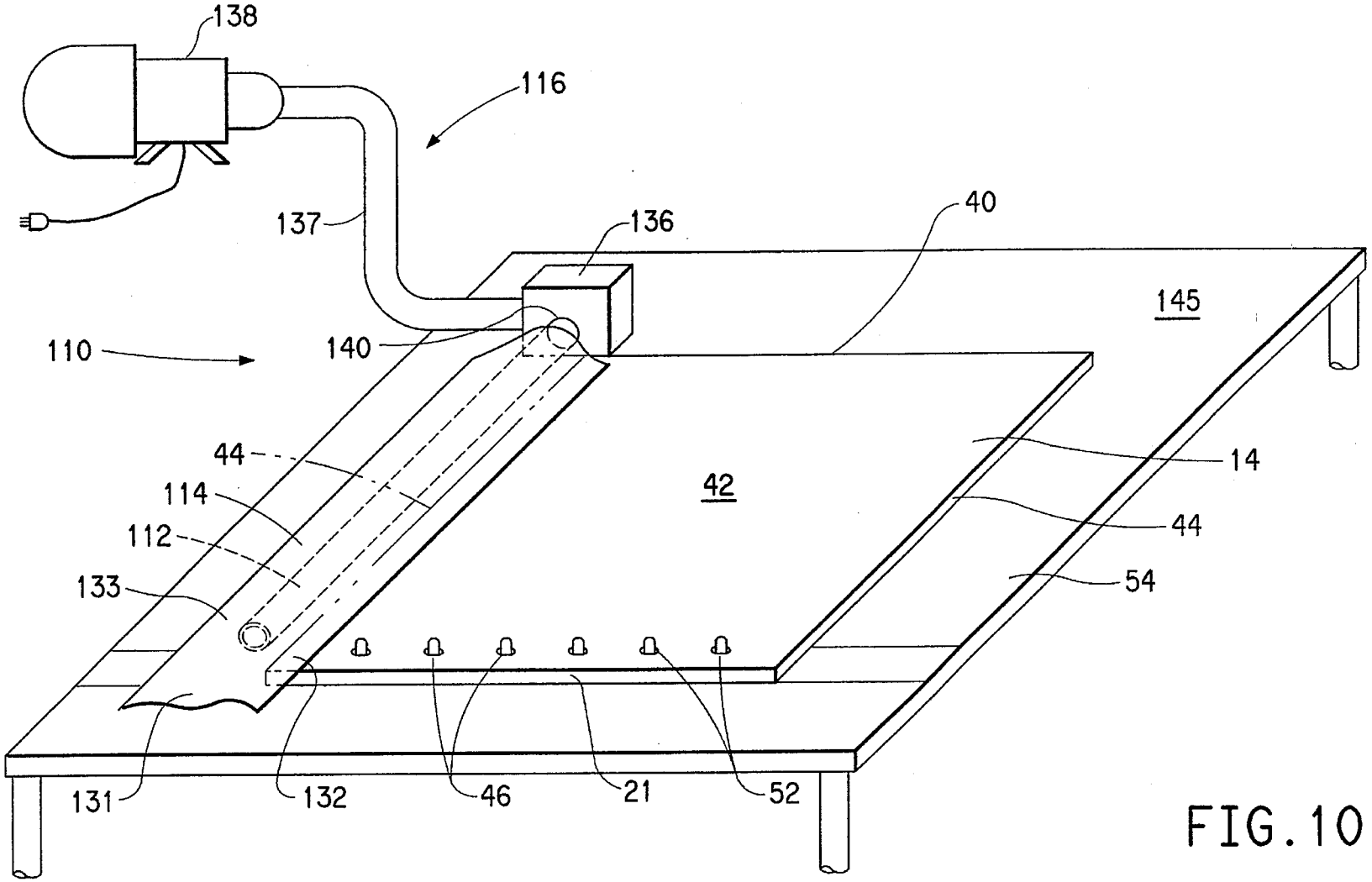
FIG. 10 is a perspective view of the apparatus for retaining a side end of the carrier sheet in position on a table associated with a drilling apparatus.

Referring to FIGS. 8, 9 and 10, an apparatus for retaining 110 one or more carrier sheets 14 in position during drilling is shown. The apparatus for retaining 110 one or more carrier sheets 14 in position includes tubular member 112, a cover 114, and a vacuum assembly 116. The tubular member 112 is a pipe having a first end 120, a second end 122 opposite the first end, a top side 124 and a bottom side 126. The first end 120 of the tubular member 112 is sealed. The second end 122 of the tubular member 112 connects to the vacuum assembly 116. On the bottom side 126 of the tubular member 112 are slit-like channels 128 which are spaced apart from each other along its length. The channels 128 can be of any shape provided that sufficient amount of air can be pulled through the channels 128 to provide a vacuum. It is preferred that the tubular member 112 be at least the length of any one dimension of the carrier sheet 14, i.e., the trailing end 40, one of the side ends 44, or the leading end 21, but can be shorter or longer. It is preferred that the tubular member 112 have an outer diameter which is substantially the same as the height of a typical stack of carrier sheets 14 which is to be drilled, but should not be so high as to interfere with the drilling apparatus. The tubular member 112 can be made from any suitable material, provided that the tubular member 112 does not collapse under vacuum and can securely hold the cover 114.

The cover 114 is a flexible member which is a means for sealing the air to the retaining apparatus 110. The cover 114 can be attached to the top side 124 of the tubular member 112 by any means, preferably by adhesive or rivets. The flexible cover member 114 has first, second and third extended portions 13 1,132,133 respectively, which overhang the tubular member 112 at the first end 120 and along both sides of the length of the tubular member 112 respectively, so that the extended portions 132 sufficiently contact the top side 42 of the carrier sheet 14 or the table 54 that the carrier sheets 14 reside on for drilling. The contact of the cover 114 to the top side 42 of the carrier sheet 14 or to the table 54 is sufficient such that an air seal is created when vacuum is drawn and any air between the carrier sheet 14 and the table 54 or other carrier sheets 14 is withdrawn. The cover 114 can be made of any material suitable to provide flexibility and assure an air seal. A preferred material for the cover 114 is rubber.

The vacuum assembly 116 is a means for supplying a vacuum and includes a vacuum block 136, a hose 137, and a vacuum pump 138. The vacuum block 136 has a first opening 140 and a second opening 141. The first opening 140 of the block 136 connects to the second end 122 of the tubular member 112. A first end 142 of the hose 137 connects to the second opening 141 of the vacuum block 136. The vacuum block 136 is used to align and locate the apparatus for retaining 110 on the table 54 for drilling and seal the vacuum at the hose 137. Power is supplied to the vacuum pump 138 by a cord 150. Opposite the first end 142 of the hose 137, the hose 137 connects to the vacuum pump 138 by conventional means. Any vacuum pump 138 conventional in the art can be used provided that it has sufficient power to pull a vacuum for the retaining apparatus 110. If more than one apparatus for retaining 110 carrier sheets 14 is use at a time, i.e., one on each end of the carrier sheet 14, it is contemplated that the multiple retaining apparatuses 110 can be connected to the same vacuum pump 138 provided that the pump 138 has sufficient capacity to pull a vacuum for all. It is preferred that at all ends 21,46,44 of the carrier sheet 14 be restricted from movement during drilling. As such, an apparatus for retaining 110 the carrier sheet 14 as described above is located on each of the two side ends 44, and the trailing end 40, and optionally along the leading end 21 of the carrier sheet 14. At a minimum, only one apparatus for retaining 110 carrier sheets 14 is placed along the end of the carrier sheet 14 most likely to shift or move during the drilling operation.

In operation, a one or more of carrier sheets 14 are placed on the table 54 of the drilling apparatus. For simplicity, FIG. 10 shows one carrier sheet 14 on the table 54 used for drilling, in which the apparatus for retaining 110 is located on one of the side ends 44 of the carrier sheet 14 to prevent movement of the end 44. The other side end 44 of the carrier plate is shown curling. The leading end 21 of the carrier sheets 14 is aligned in position by engaging the openings 30 on the leading end 21 of the carrier sheet 14 to the pins 52 on the table 54. The tubular member 112 of the retaining apparatus 110 is abutted lengthwise adjacent to the end 44 of the carrier sheet 14 and the second extended portion 132 of the cover 114 adjacent to the carrier sheet 14 is placed on the top side 42 of the carrier sheet 14. The first extended portion 131 and third extended portion 133 of the cover 114 are placed in contact with a top surface 145 of the table 54. The second end 122 of the tubular member 112 is connected to the block 136 of the vacuum assembly 116. Optionally, a second and a third apparatuses for retaining 110 the trailing end 40 and the other side end 44 could be similarly placed adjacent to the carrier sheet 14. The vacuum pump 138 is turned on whereupon a vacuum is drawn creating a seal with the extended portions 131,132,133 of the cover 114 of the retaining apparatus 110, pulling air from between the carrier sheet 14 and the table 54 (and between the carrier sheets 14 in a stack). The withdrawl of air by vacuum flatens the curling end 44 of the carrier sheet 14 onto the table 54 and thus prevents the carrier sheet 14 from shifting or moving during drilling. The second set of openings 50 are drilled in the carrier sheet 14. The vacuum pump 138 is turned off, the retaining apparatus 110 is removed, and the plates 12 are mounted to the carrier sheets 14 as described above.

The applicant has found a method to accurately align and attach the bar 10 to the carrier sheet 14 which is easy, productive, and eliminates any misalignment of the bar 10 to the carrier sheet 14. By mounting the flexographic printing plate 12 on the carrier sheet 14 using the preferred method of the video-head drill in conjunction with the apparatus for retaining 110 the carrier sheets 14 in place during drilling, the plate is accurately aligned on the carrier sheet 14. The plate 12 is thus accurately aligned with the bar 10. Since the bar 10 resides in a longitudinal slot 18 parallel to the cylinder axis 72 on the printing cylinder 16, the plate 12 is aligned in registration on the cylinder 16. The position of the bar 10 on the longitudinal slot 18 of the cylinder 16 is accomplished by conventional means such as by aligning a mark on the mounting bar 10 to a mark on the printing cylinder 16. Thus the alignment of the plate 12 on the carrier sheet 14 on the printing cylinder 16 is the same for each color, and accuracy in registration of the printed image is assured. The method of the present invention is particularly preferred when printing multicolor images wherein a printing plate 12 for each of the colors to be printed must be mounted via a carrier sheet 14 onto a printing cylinder 16 for each color.

The applicant has found an alternate method for mounting a printing plate 12 onto a printing cylinder 16 using the bar 10 and locking pins 56 in which the printing plate 12 is directly attached to the bar 10. This alternate embodiment offers the advantages of eliminating the carrier sheet 14 and the step of mounting the printing plate 12 on the carrier sheet 14, in addition to the advantages in registration.

In addition to the advantages in mounting and print registration, other advantages of the present method for mounting flexographic printing plates are reduced costs and increased productivity since the mounting bars and locking pins can be reused and the assembly of the mounting bars to the carrier sheets is quick and easy.

Those skilled in the art, having benefit of the teachings of the present invention as hereinabove set forth, can effect numerous modifications thereto. These modifications are to be construed as being encompassed within the scope of the present invention as set forth in the appended claims.

We claim:

1. A method for mounting a flexographic printing plate having a relief image on a printing cylinder having a slot, the method comprising:

(a) providing a sheet which is either a carrier sheet having the printing plate attached or the printing plate;

(b) punching at least two openings in the sheet spaced apart in a row parallel to the leading end;

(c) providing a bar having a first arm with a coupling end and a second arm with multiple openings spaced apart in a row parallel to the coupling end;

(d) aligning the at least two openings in the sheet to at least two of the multiple openings of the second arm;

(e) securing the bar to the sheet by placing locking pins in the openings aligned in step d); and (f) mounting the bar on the printing cylinder so the coupling end of the first arm engages the slot and remains in place on the cylinder during printing.

2. The method of claim wherein the sheet is the carrier sheet having the printing plate attached.

3. The method of claim 2 wherein step a) further comprises:

(a1) drilling a second set of at least two openings in the carrier sheet;

(a2) attaching on the carrier sheet the printing plate having registration openings, so that the registration openings in the printing plate align with at least two of the second set of openings in the carrier sheet.

4. The method of claim 2 wherein after printing by the printing plate, the process further comprises:

(g) removing the locking pins from the aligned openings in the bar and carrier sheet; and, (h) reusing the bar on a second carrier sheet.

5. The method of claim 1 wherein the mounting step comprises engaging the coupling end of the first arm to an extended member of the slot.

6. The method of claim 1 wherein the openings at the leading end of the sheet are multiple openings and the shape of the openings are selected from the group consisting of circular shaped and oblong shaped.

7. The method of claim 1 wherein the locking pins have a cylindrical shaft having a diameter and the multiple openings in the bar are circular shaped with a diameter which is the same or substantially the same as the diameter of the shaft.

8. The method of claim 1 wherein the locking pins have a shaft having a locking cap and the securing step comprises: (e1) inserting the shaft of the locking pins into the aligned openings until the locking cap engages a bottom side of the bar.

9. The method of claim 3 wherein the attaching step further comprises:

(1) applying an adhesive material to a back of the printing plate;

(2) aligning the registration openings on the printing plate with at least two of the second set of openings in the carrier sheet;

(3) placing mounting pins in the openings which were aligned in step d) to bring the adhesive on the back of the plate in contact with the carrier sheet, and thereby mount the plate one the carrier sheet; and (4) removing the mounting pins from the openings.

10. The method of claim 2 wherein the sheet further comprises a trailing end opposite the leading end and two side ends, and wherein the method further comprises during the drilling step:

c1) retaining at least one of the two side ends or the trailing end.

11. A process for mounting an aligned flexographic printing plate having relief image to a printing cylinder having a slot comprising:

(a) providing a mountable flexographic printing element having a relief image comprising:

(i) a carrier sheet having a leading end;

(ii) a bar having a first arm with a coupling end and a second arm with multiple openings spaced apart in a row parallel to the coupling end wherein said bar is secured to the leading end of the carrier sheet by locking pins inserted into the carrier sheet and the multiple openings of the second arm, wherein the locking pins secure the bar to the carrier sheet in an aligned manner;

(iii) a least one flexographic printing plate having a relief image attached to the carrier sheet;

(b) mounting the coupling end of the mountable flexographic printing element to the slot of the printing cylinder.

12. A method of manufacturing a mountable flexographic printing element having a relief image, comprising:

(a) punching at least two openings in a carrier sheet having a leading end spaced apart in a row parallel to the leading end;

(b) attaching a bar having a first arm with a coupling end and a second arm with multiple openings spaced apart in a row parallel to the coupling end using a plurality of locking pins to the carrier sheet; and (c) attaching a flexographic printing plate having a relief image to the carrier sheet to form the mountable flexographic printing element.

13. An apparatus for mounting a flexographic printing plate having a relief image on a printing cylinder having a slot, the apparatus comprising:

(a) a carrier sheet having a leading end with at least two openings spaced apart in a row parallel to the leading end;

(b) a bar having a first arm with a coupling end for engaging the slot in the cylinder and a second arm with multiple openings spaced apart in a row parallel to the coupling end, wherein at least two of the multiple openings of the second arm are aligned to the openings in the carrier sheet; and (c) at least two locking pins for securing the carrier sheet to the bar at the at least two aligned openings.

14. The apparatus of claim 13 wherein the at least two aligned openings have a diameter, and the locking pins comprise:

a) a shaft having a first end and a second end, and a diameter corresponding to the diameter of the aligned openings;

b) a base perpendicular to the shaft at the first end and having a diameter larger than the diameter of the aligned opening; and c) a locking cap at or near the second end having a diameter greater than the diameter of the aligned openings.

15. A flexographic printing element having a relief image, comprising:

(a) a carrier sheet having a plurality of openings on a leading end;

(b) at least one flexographic printing plate having a relief image attached to the carrier sheet;

(c) a bar having a first arm with a coupling end and a second arm with multiple openings spaced apart in a row parallel to the coupling end; and (d) a plurality of locking pins wherein the pins secure the bar to the carrier sheet in an aligned fashion through the openings on the leading end of the carrier sheet and on the second arm of the bar.

* * * * *